US008187158B2

(12) United States Patent
Vallonthaiel

(10) Patent No.: US 8,187,158 B2
(45) Date of Patent: May 29, 2012

(54) PAPER FOLDING STATION

(75) Inventor: Joseph B. Vallonthaiel, Kerala (IN)

(73) Assignee: Petratto S.r.l., Venaria Reale (IT)

( * ) Notice: Subject to any disclaimer, the term of this patent is extended or adjusted under 35 U.S.C. 154(b) by 0 days.

(21) Appl. No.: 12/326,961

(22) Filed: Dec. 3, 2008

(65) Prior Publication Data

US 2010/0137119 A1 Jun. 3, 2010

(51) Int. Cl.
*B65H 45/14* (2006.01)

(52) U.S. Cl. ..... 493/420; 493/419; 493/443; 493/446; 493/455

(58) Field of Classification Search ..... 493/420, 493/419, 422, 424, 442–443, 446, 454, 455
See application file for complete search history.

(56) References Cited

U.S. PATENT DOCUMENTS

| | | | | |
|---|---|---|---|---|
| 3,804,399 | A * | 4/1974 | Rupp | 493/421 |
| 4,099,710 | A * | 7/1978 | Boyer et al. | 493/420 |
| 4,601,695 | A * | 7/1986 | Pazzi | 493/418 |
| 4,621,966 | A * | 11/1986 | Luperti et al. | 414/789.9 |
| 5,044,617 | A * | 9/1991 | Roberts | 270/45 |
| 5,108,082 | A * | 4/1992 | Shea et al. | 270/47 |
| 5,135,465 | A * | 8/1992 | Hirahara | 493/442 |
| 5,242,364 | A * | 9/1993 | Lehmann | 493/8 |
| 5,967,963 | A * | 10/1999 | Gotting | 493/420 |
| 6,086,522 | A * | 7/2000 | Hechler | 493/23 |
| 6,620,279 | B2 * | 9/2003 | Lindsay et al. | 156/227 |
| 6,635,006 | B2 * | 10/2003 | Auerbach et al. | 493/419 |
| 6,641,514 | B1 * | 11/2003 | Hechler | 493/8 |
| 6,857,996 | B2 * | 2/2005 | Dorer | 493/419 |
| 7,175,738 | B2 * | 2/2007 | Lindsay et al. | 156/442.1 |
| 7,699,309 | B2 * | 4/2010 | Markgraf | 271/212 |
| 2003/0109367 | A1 | 6/2003 | Dannemann et al. | |

FOREIGN PATENT DOCUMENTS

| | | |
|---|---|---|
| EP | 0595105 | 5/1994 |
| GB | 1066398 | 4/1967 |

* cited by examiner

*Primary Examiner* — Christopher Harmon
(74) *Attorney, Agent, or Firm* — Lieberman & Brandsdorfer, LLC

(57) ABSTRACT

A paper folding station with a paper-feeder and a first pair of motorized rollers supported at a delivery end of the paper-feeder about respective parallel axes to draw sheets of paper from the feeder. One of the rollers is mounted on a first adjustable support. A folding buckle is provided to receive the sheets from the first pair of rollers through an inlet mouth. The buckle has a barrier causing the sheets to stop and bend into the shape of a groove below the inlet mouth. A second pair of rollers is supported near the inlet mouth about respective parallel axes to pinch the groove and to make a transverse fold on the sheet. The paper-folding station further comprises at least one transverse beam to guide the sheet near the inlet mouth.

9 Claims, 3 Drawing Sheets

PAPER FOLDING STATION

BACKGROUND OF THE INVENTION

1. Technical Field

The present invention relates to a paper-folding station for sheets of paper generally used for assembling books, magazines, and the like.

2. Description of the Prior Art

As known, paper sheets can be folded for manufacturing parts of books and magazines by means of so-called "pocket" folding stations, which allow the sheet to be folded transversely to the sheet-feeding direction along parallel lines. A paper-folding station generally comprises one or more folding units each having a triad of rollers arranged in square, two adjacent of which feed the sheet into a thin chamber, known as "pocket" or "buckle", having an adjustable thickness, with an inlet mouth and an adjustable transversal barrier which cause the sheets to stop and to bend into the shape of a groove below the inlet mouth. The groove progressively lengthens up to meet two adjacent folding rollers of the triad, which pinch the bottom of the groove and form the fold on the sheet.

The inlet mouth of the buckle is delimited between a lower profile, which must be as near as possible to, and along the tangent of, the outer folding roller, and an upper profile which also functions as a guide for a correct formation of the groove on the sheet. Since an accurate positioning of the profiles with respect to the rollers is critical for achieving an accurate and regular fold, as well as for reducing the risk of jamming, in the known paper-folding stations an accurate construction and assembling of the buckle is required, which buckle, consequently, is very fragile to use as well as expensive to manufacture, also because it must be made movable and removable from the structure of the machine which supports the folding rollers, in order to allow the operator either to carry out the required adjustments or to remedy any jamming of the paper.

Furthermore, in the known paper-folding stations, adjusting the position of the inlet mouth is an awkward operation because, when the buckle is in its operative position, it is not possible to control the exact position of the inlet mouth relative to the rollers, so that external rulers divided into millimeters must be used, which rulers, however, have a very low resolution.

SUMMARY OF THE INVENTION

Therefore, it is a main object of the present invention to improve the above-described paper-folding station in order to remove the drawbacks concerning the adjustment of the inlet mouth of the buckle, as well as to simplify the driving of the machine even by unskilled operators.

The above object and other advantages, which will better appear below, are achieved by the paper-folding station having the features as claimed in the attached claims.

BRIEF DESCRIPTION OF THE DRAWINGS

The invention will be now described in more detail with reference to a preferred, non-exclusive embodiment, shown by way of non limiting example in the attached drawings, wherein.

DETAILED DESCRIPTION OF THE INVENTION

Figure 1:
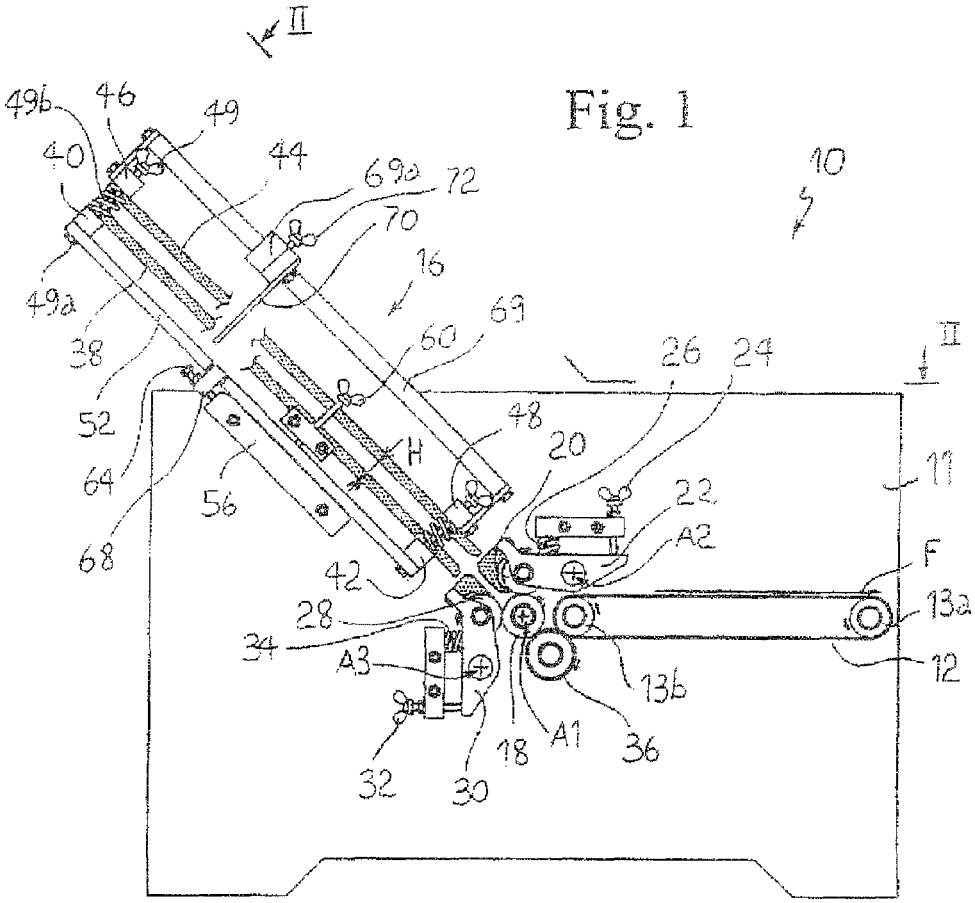
FIG. 1 is a broken away view in side elevation of a paper-folding station according to the invention.
Figure 2:
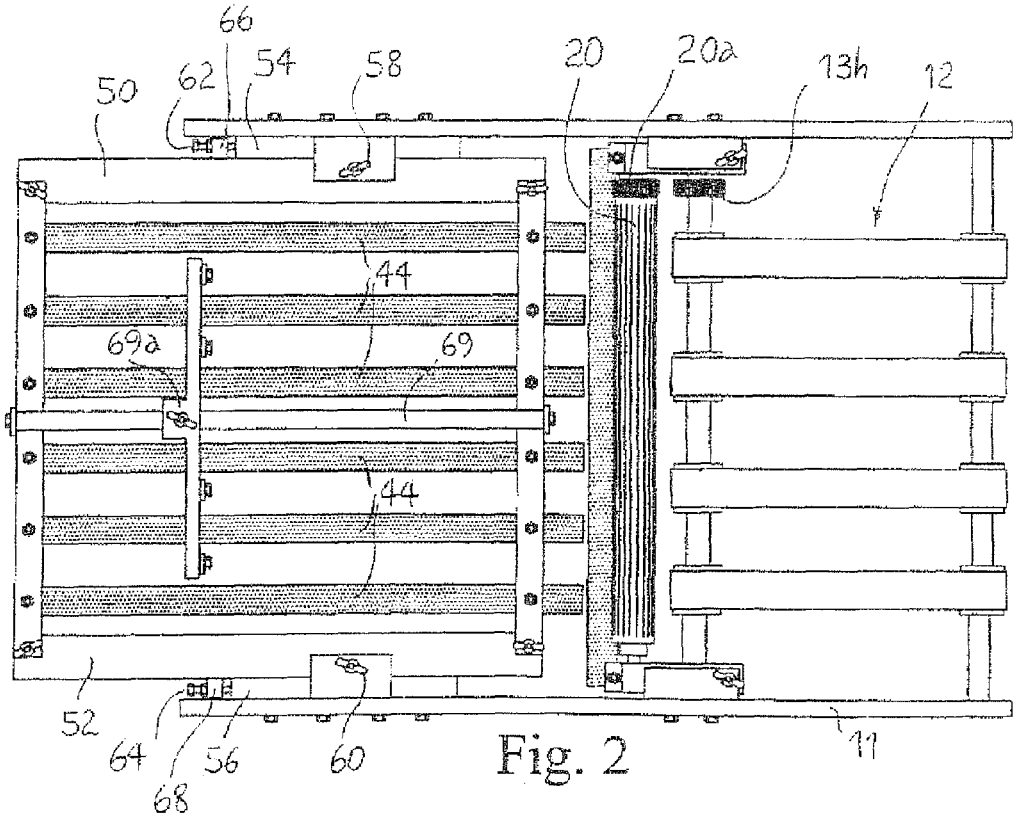
FIG. 2 is a plan view of the paper-folding station of FIG. 1, made along line II-II of FIG. 1.
Figure 3:
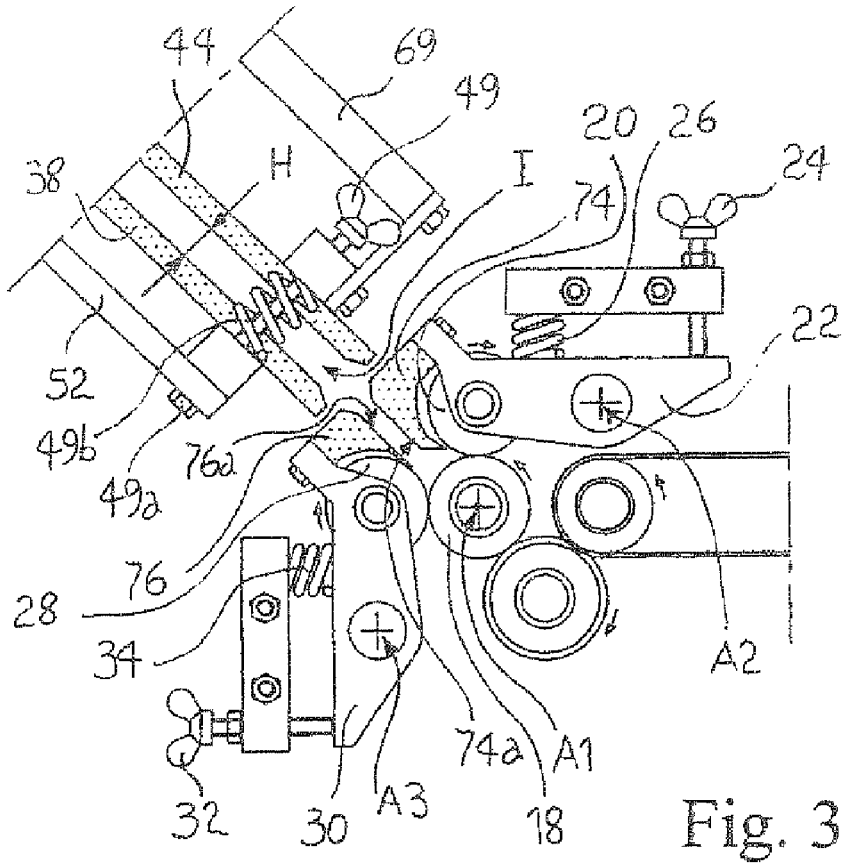
FIG. 3 shows a detail of FIG. 1 to an enlarged scale.
Figure 4:
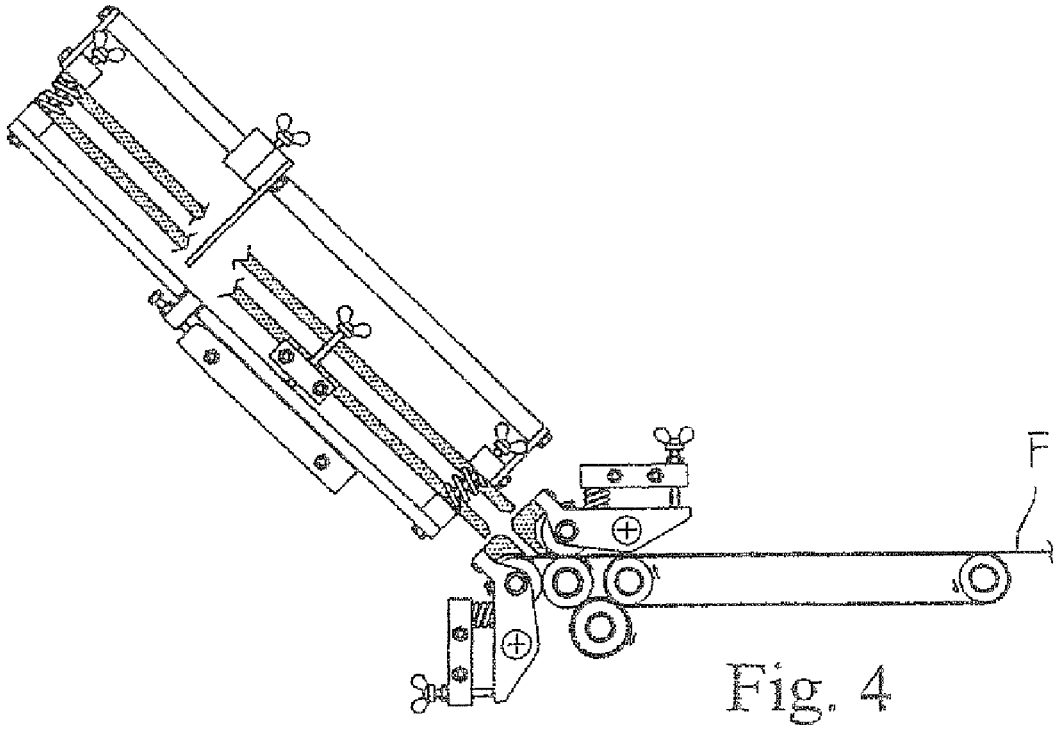
FIGS. 4 to 7 are views similar to FIG. 1 and showing the paper-folding station during four successive operative steps.

With initial reference to FIGS. 1 to 3, a paper-folding station 10 comprises a frame 11 supporting a motorized conveyor belt 12 extending between two pulleys 13*a*, 13*b* and arranged to feed sheets of paper such as F to a folding buckle 16, which will be better described below. A triad of parallel and adjacent rollers arranged in a square is supported at the delivery end of conveyor belt 12. A first roller 18 is supported about a first transverse axis A1 at the delivery end of conveyor belt 12 for receiving sheets from it. A second roller 20 parallel to first roller 18 is supported above the latter on a first swinging support 22 that is pivoted about a second transverse axis A2. The angular position of first swinging support 22 is adjustable by a threaded knob 24 acting against a spring 26 in order to change the distance between the first roller and the second roller. Similarly, a third roller 28 is supported at a position diametrically opposed to conveyor belt 12 with respect to first roller 18, on a second swinging support 30 pivoted about a third transverse axis A3. The angular position of second swinging support 30 is also adjustable by a threaded knob 32 acting against a spring 34 in order to change the distance between the first roller and the third roller. An idle gearwheel 36 transmits the motion from a driving gearwheel 31*h*, which is integral with delivery pulley 13*b* of conveyor belt 12, to first roller 18, which has a respective gearwheel (not shown) meshing with idle gearwheel 36, at one of its ends. Second roller 20 and third roller 28 also have respective gearwheels integral with them, such as 20*a*, with reference to second roller 20, which mesh with the gearwheel of the first roller.

Folding buckle 16 comprises a first array of longitudinal, parallel bars 38 defining a lower sliding surface and interconnected by a first pair of transverse rods 40, 42, as well as a second array of longitudinal, parallel bars 44 arranged above the first bars and interconnected by a second pair of transverse rods 46, 48 to define an upper sliding surface. Transverse rods 40, 42 supporting the lower bars are connected to transverse rods 46, 48 supporting the upper bars via threaded tie rods such as 49 with respective nuts 49*a*, with interposition of respective springs 49*b*. Therefore, a thin gap H is defined between the upper sliding surface and the lower sliding surface, with a mouth I (FIG. 3) through which the sheets to be folded are insertable. The thickness of the gap is manually adjustable by operating tie rods 49. The transverse rods supporting the lower bars are mounted on a pair of longitudinal members 50, 52 lying on respective slanting guides 54, 56 which are attached to frame 11 and are locked in position by respective locking knobs 58, 60. The longitudinal position of longitudinal members 50, 52 with respect to guides 54, 56 is accurately adjustable by means of a pair of respective adjusting screws 62, 64, which are screwed to respective projections 66, 68 integral with the longitudinal members and arranged to abut against guides 54, 56 in a longitudinal direction. Between transverse rods 46, 48 supporting the upper bars, a rod 69 parallel to the bars is anchored, along which a slide 69*a* is slidable. Slide 69*a* supports an array of parallel bands 70 projecting into the intervals between the bars to define a barrier for the sheet entering the buckle. Slide 69*a* is lockable in position by a respective threaded locking knob 72.

According to the invention, first swinging support 22 and second swinging support 30 bear respective transverse bears 74, 76 (FIG. 3) which partially surround the respective rollers and have respective, mutually facing plane surfaces 74*a*, 76*a* having a thin passage defined therebetween, with an inlet section at the level of the line of tangency between first roller 18 and second roller 20, and an outlet section leading to mouth I of folding buckle 16. Beams 74, 76 are arranged obliquely so that the thin passage defined therebetween substantially has the same slant of buckle 16.

Figure 5:
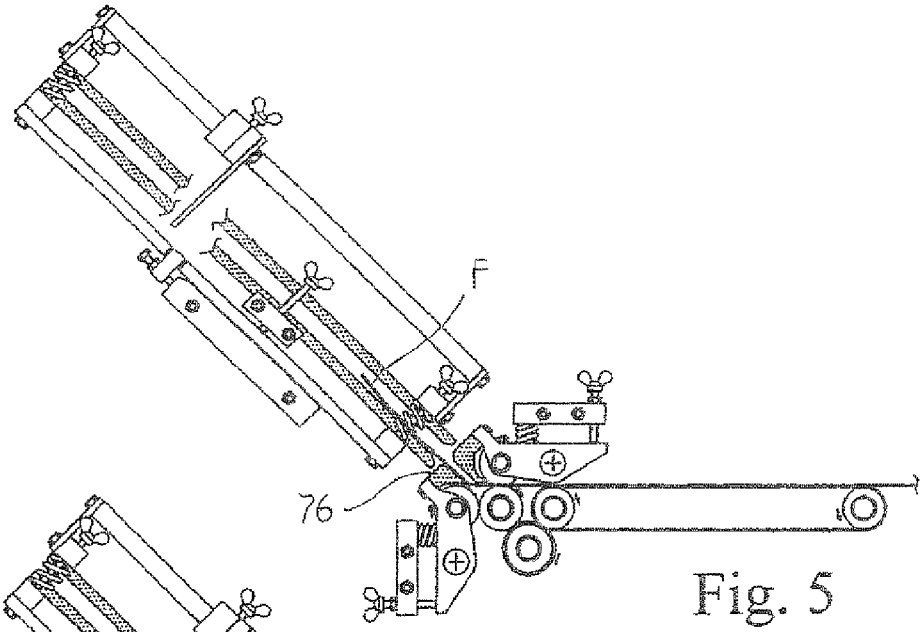
Figure 6:
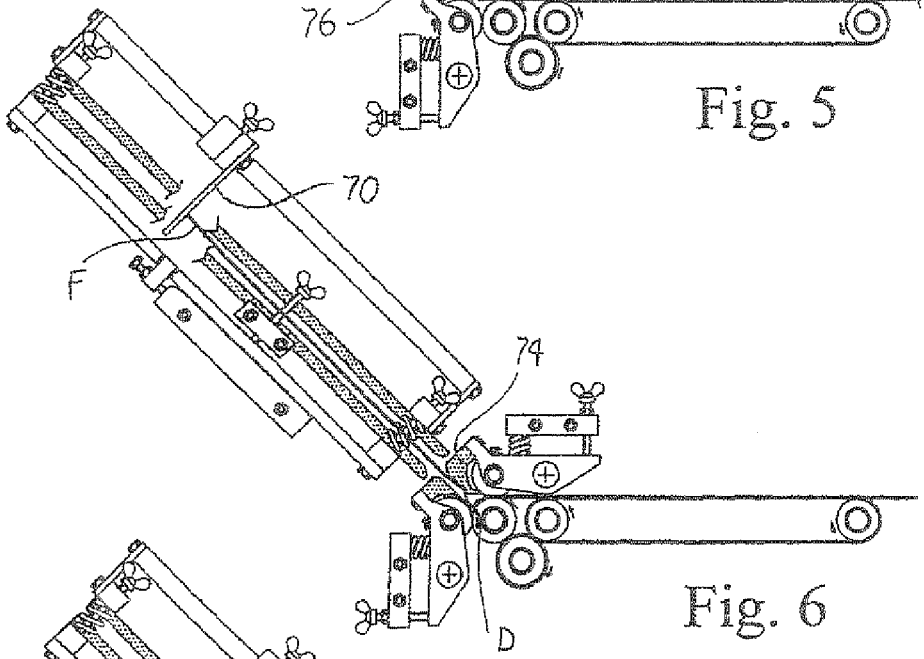
Figure 7:
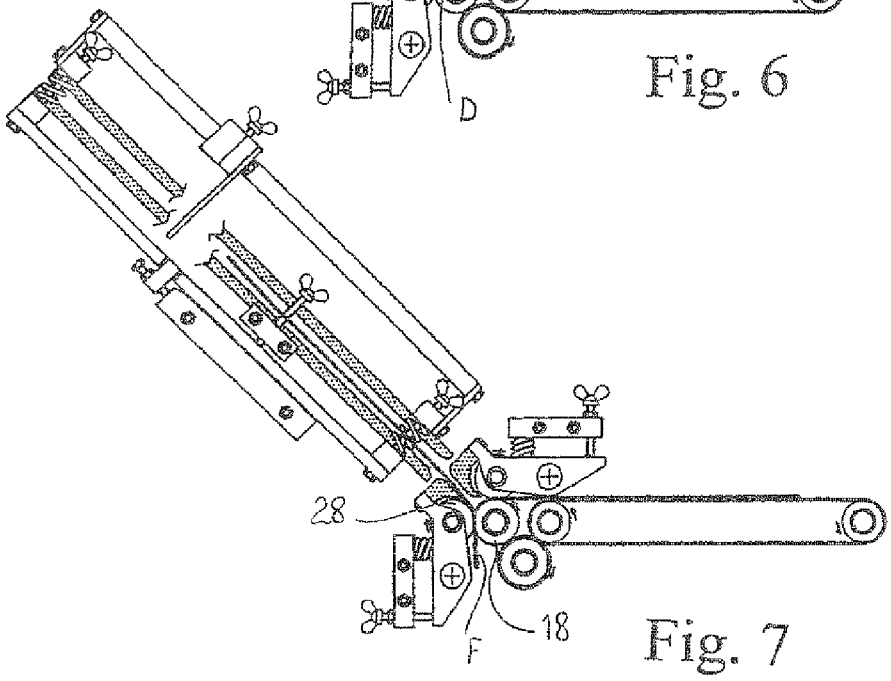

Having now particular reference to FIGS. 4 to 7, in the operation conveyor belt 12 feeds sheets of paper to first roller 18 and second roller 20, which draw the sheets and convey them to the folding buckle via the slanting passage defined between upper beam 74 and lower beam 76, which accurately guide the insertion of the sheets into the buckle. In particular, as shown in FIG. 5, each sheet is deviated by lower beam 76 to enter the mouth I defined between lower bars 38 and upper bars 44. The sheet moves forward until it abuts against the barrier defined by the bands 70, then it starts to bend into the shape of a groove D below inlet mouth I (FIG. 6). As shown in FIG. 6, during the formation of the groove the sheet is biased against upper beam 74 which, accordingly, controls the bending of the sheet, thereby defining the correct geometry of the groove. Finally, groove D progressively lengthens until it is pinched between first roller 18 and third roller 28 which form the transverse fold on the sheet.

The position of the beams with respect to the rollers is defined in the designing stage by a person skilled in the art in order to definitively optimize the insertion of the sheet and the formation of the groove, when the sheet is biased against the upper beam. Thereafter, no other adjustments are required, because whenever the distance either between first roller 18 and second roller 20 or between first roller 18 and third roller 28 must be adjusted by operating knobs 24 or 32, the beams will integrally follow the movements of the respective rollers, thereby maintaining the correct relative position with respect to the rollers. Of course, any removal and reinstalling of the buckle for adjustments or jamming does not affect the accuracy of the insertion of the sheets and of the formation of the groove.

With the paper-folding station according to the invention, only the distance between the upper surface and the lower surface, as well as the position of the barrier, can be adjusted in the buckle, which adjustments, as mentioned above, are coarse and consequently are not affected by inaccuracies of positioning and of assembling of the buckle. Accordingly, since the tolerances of manufacturing and of positioning of the buckle are less restrictive, the buckle can he manufactured in a way less expensive then the conventional buckles.

A preferred embodiment of the invention has been described herein, but of course many changes may be made by a person skilled in the art within the scope of the claims. In particular, in a way similar to the conventional paper-folding stations, the station according to the invention could be provided with a plurality of folding buckles arranged to perform a number of parallel folds on the sheets, in a way that will be obvious to a person skilled in the art. Furthermore, though in the preferred embodiment both the rollers mounted on swinging supports are provided with respective beams, a considerable improvement could be achieved by providing only one of the rollers with a beam. Moreover, the swinging supports could also be replaced with other movable supports of a different type, for instance, supports mounted on rectilinear guides, provided that they allow the distance between the respective rollers and first roller 18 to be accurately adjusted. Furthermore, the beams could also be mounted on respective dedicated supports designed to follow the movements of the respective rollers.

I claim:

1. A paper-folding station, comprising:

a frame;

a paper-feeder;

a first pair of motorized, substantially adjacent rollers, including a first roller and a second roller, supported at a delivery end of the paper-feeder about respective parallel axes to draw sheets of paper from the feeder, one roller of the first pair being mounted on a first support, the first support adjustable in position to change the distance between the rollers of the first pair;

a folding buckle arranged to receive a sheet from the first pair of rollers through an inlet mouth, and having a barrier causing the sheets to stop and to bend into the shape of a groove below the inlet mouth;

a second pair of motorized, substantially adjacent rollers, including one of said first and second rollers and a third roller, supported near the inlet mouth about respective parallel axes to pinch the groove and to make a transverse fold on the sheet, one roller of the second pair being mounted on a second support adjustable in position to change the distance between the rollers of the second pair, wherein said paper folding station comprises at least one transverse beam coupled to one of said first and second supports so as to follow changes in position of said one of said first and second supports upon adjustment of the distance between the corresponding pair of rollers, said at least one transverse beam being located in a vicinity of the inlet mouth to guide said sheets.

2. The paper folding station of claim 1, further comprising at least one transverse profile integrally connected to the first and second respective support.

3. The paper-folding station of claim 1, further comprising a transverse beam associated with the first support and arranged to control a bending of the sheet during the formation of the groove, thereby defining a correct geometry of the groove.

4. The paper-folding station of claim 1, further comprising a transverse beam associated with the second support and arranged to guide the insertion of the sheet into the buckle.

5. The paper-folding station of claim 1, further comprising the first support and the second support bearing respective transverse beams, each of the transverse beams being integral with the respective support, the transverse beams defining a passage there between with an inlet section near the first pair of rollers and an outlet section leading to the mouth.

6. The paper-folding station of claim 1, further comprising at least one of the supports adjustable in position and pivoted to the frame under an action of a knob acting against an elastic means.

7. The paper-folding station of claim 1, further comprising at least one of the supports adjustable in position by rotation about a first axis, said first axis different from a rotation axis of a roller mounted on said at least one support.

8. The paper-folding station of claim 5, further comprising the passage to guide insertion of the sheet into the buckle.

9. The paper-folding station of claim 8, wherein the passage is positioned at a slant.

* * * * *